US009631588B2

(12) United States Patent
Nomura

(10) Patent No.: US 9,631,588 B2
(45) Date of Patent: Apr. 25, 2017

(54) INTAKE MANIFOLD

(75) Inventor: Takeshi Nomura, Chiryu (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 780 days.

(21) Appl. No.: 13/160,835

(22) Filed: Jun. 15, 2011

(65) Prior Publication Data

US 2011/0315109 A1 Dec. 29, 2011

(30) Foreign Application Priority Data

Jun. 28, 2010 (JP) ..... 2010-146237

(51) Int. Cl.
*F02M 35/116* (2006.01)
*F02M 35/10* (2006.01)

(52) U.S. Cl.
CPC .... *F02M 35/1165* (2013.01); *F02M 35/1036* (2013.01); *F02M 35/10327* (2013.01)

(58) Field of Classification Search
CPC ..... F02M 35/1165; F02M 35/10327; F02M 35/1036
USPC ..... 123/184.47, 184.21, 184.31, 184.34, 123/184.38, 184.42
See application file for complete search history.

(56) References Cited

U.S. PATENT DOCUMENTS 4,719,879 A * 1/1988 Kato et al. ..... 123/184.38
6,807,957 B2 * 10/2004 Ko ..... 123/572
7,082,915 B2 * 8/2006 Tanikawa et al. ..... 123/184.42
7,357,110 B2 * 4/2008 Hashimoto et al. ..... 123/184.47
7,581,522 B2 * 9/2009 Enokida ..... 123/184.34
2009/0301423 A1 * 12/2009 Usuda ..... 123/184.42
2010/0242892 A1 9/2010 Takakuwa et al.

FOREIGN PATENT DOCUMENTS

| | | |
|---|---|---|
| JP | 05-000952 | 1/1993 |
| JP | 08-216259 | 8/1996 |
| JP | 09-189271 | 7/1997 |
| JP | 10-077918 | 3/1998 |
| JP | 11-141424 | 5/1999 |
| JP | 2002-054518 | 2/2002 |
| JP | 2007-008134 | 1/2007 |
| JP | 2008-184939 | 8/2008 |

OTHER PUBLICATIONS

Japanese Office action, mail date is Nov. 5, 2013.
Japanese Office action dated Apr. 22, 2014.

* cited by examiner

*Primary Examiner* — Jacob Amick
(74) *Attorney, Agent, or Firm* — Greenblum & Bernstein, P.L.C.

(57) ABSTRACT

An intake manifold includes a surge tank and a plurality of inlet pipes extending from the surge tank. Of the inlet pipes, proximal portions of an adjacent pair of inlet pipes are integrated, for example, by being connected with a plate-like connecting portion. The proximal portions of the two adjacent inlet pipes are integrated with a side wall of the surge tank by a reinforcing rib. The reinforcing rib extends, for example, from the connecting portion to the side wall of the surge tank. The intake manifold may be formed by a lower half body and an upper half body, which are welded to each other by using welding margins provided in the half bodies. In this case, it is preferable that parts of each welding margin that are located to correspond to the proximal portions of the inlet pipes be wider than the remainder of the same welding margin.

4 Claims, 5 Drawing Sheets

INTAKE MANIFOLD

BACKGROUND OF THE INVENTION

The present invention relates to an intake manifold for an engine.

Japanese Laid-Open Patent Publication No. 2008-184939 discloses an intake manifold that includes a manifold body. The manifold body is a synthetic resin single component that includes a surge tank and a plurality of inlet pipes. Synthetic resin internal pipes are provided inside the manifold body. Each internal pipe protrudes into the surge tank from the proximal portion of one of the inlet pipes, or from a portion of the inlet pipe that is coupled to the surge tank.

Because of the internal pipes provided separately from the manifold body, the conventional intake manifold has a large number of components and a complicated structure. Omission of the internal pipes would simplify the structure. However, such omission would lower the pressure capacity of portions of the intake manifold including the proximal portions of the inlet pipes. The internal pipes have a function for correcting molding strains, which often occur in the vicinity of the proximal portions of the inlet pipes when a surge tank and inlet pipes are integrally molded with synthetic resin. The omission of the internal pipes would therefore make drawbacks due to molding strains conspicuous.

SUMMARY OF THE INVENTION

Accordingly, it is an objective of the present invention to provide an intake manifold of a simple structure with a small number of components, in which the pressure capacity of portions of the intake manifold including the proximal portions of the inlet pipes is high, and molding strains do not easily occur in the vicinity of the proximal portions of the inlet pipes.

To achieve the foregoing objective and in accordance with one aspect of the present invention, an intake manifold is provided that includes a surge tank having an opening; and a plurality of inlet pipes extending from the surge tank. Each inlet pipe has an inlet connected to the surge tank. The inlet of each inlet pipe is located side by side with the inlet of another inlet pipe in a direction along which air supplied into the surge tank through the opening flows within the surge tank. Of the inlet pipes, proximal portions of an adjacent pair of inlet pipes are integrated, and the proximal portions of the pair are integrated with a side wall of the surge tank by a reinforcing rib.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

Hereinafter, one embodiment of the present invention will now be described with reference to FIGS. 1 to 5. In the following description, left and right refer to the left and right sides as viewed in FIG. 2, respectively, and front and rear refer to the lower and upper sides as viewed in FIG. 2, respectively.

Figure 1:
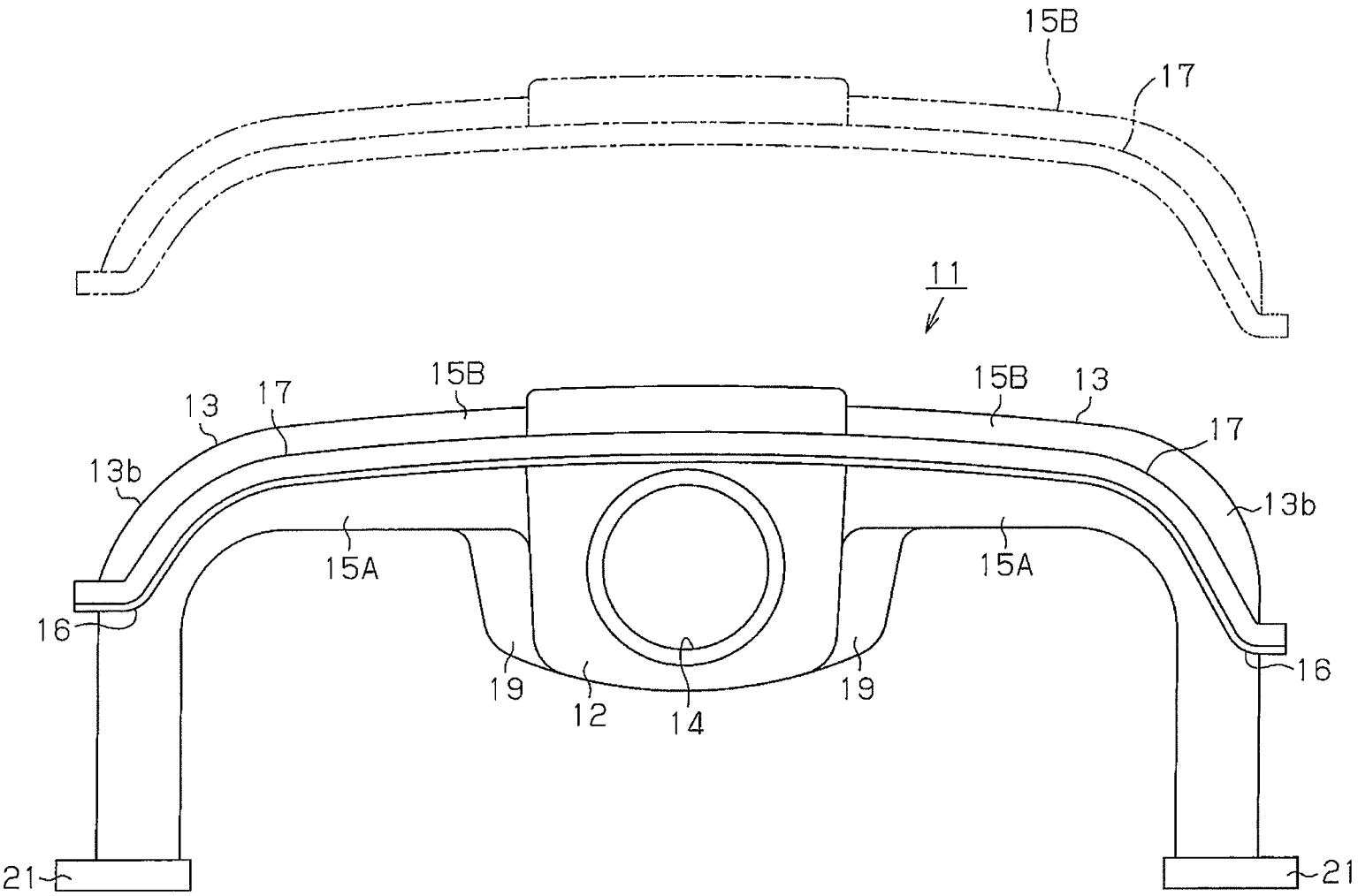
FIG. 1 is a front view illustrating an intake manifold according to one embodiment of the present invention.
Figure 2:
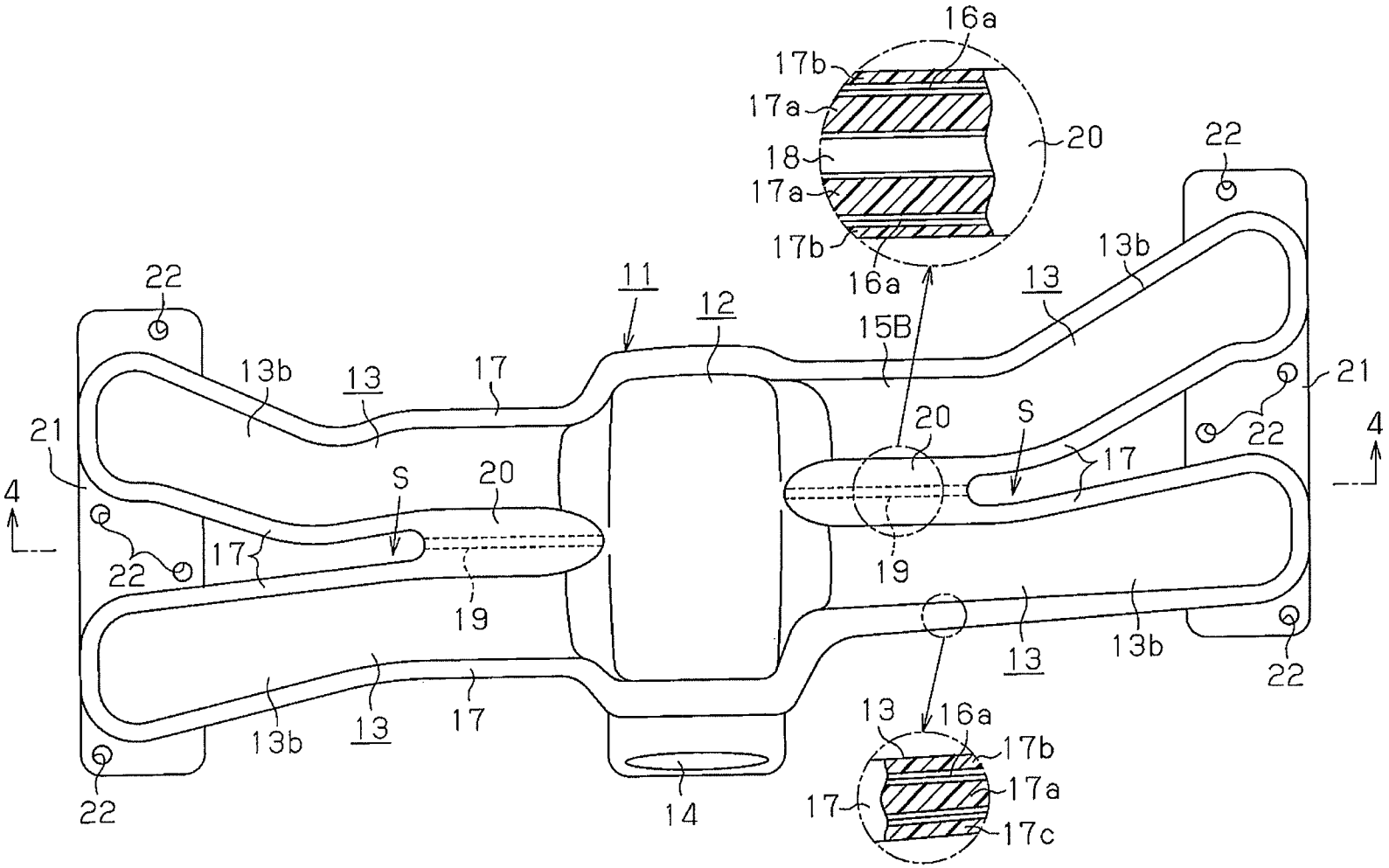
FIG. 2 is a plan view of the intake manifold shown in FIG. 1.

An intake manifold 11 according to the present embodiment is mounted in a horizontally-opposed four-cylinder engine. The intake manifold is formed, as a single component, of heat-resistant synthetic resin such as a polyamide resin. As shown in FIGS. 1 and 2, the intake manifold 11 includes a surge tank 12 and a plurality of inlet pipes 13. The surge tank 12 is located at a center of the intake manifold 11. The inlet pipes 13 extend from the left and right sides of the surge tank 12. The inlet pipes 13 are substantially at left-right symmetrical positions.

Figure 3:
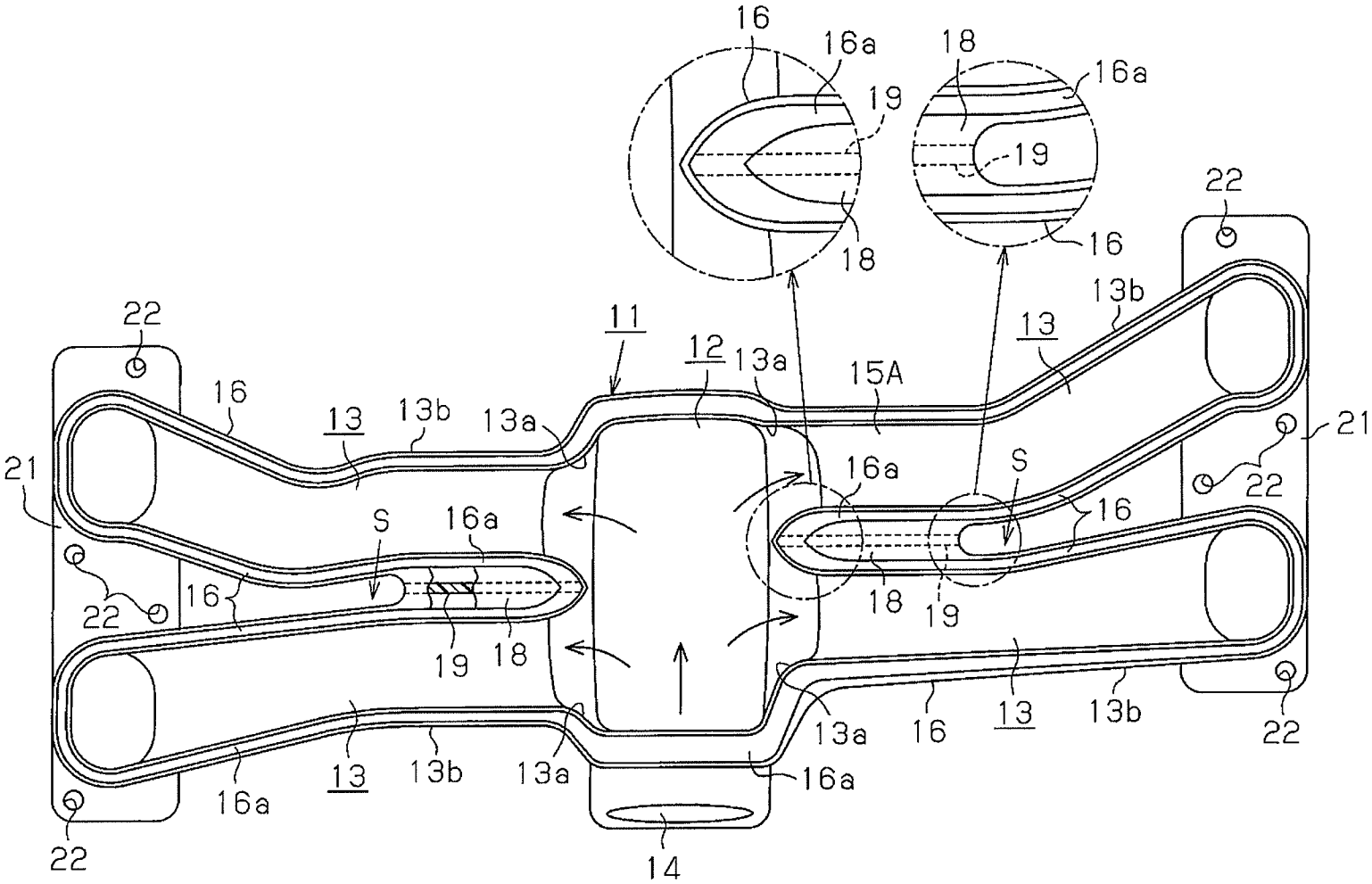
FIG. 3 is a plan view of the intake manifold shown in FIG. 1, showing a state where the upper half body has been removed.

As shown in FIGS. 1 and 3, an opening 14 is formed at the front side of the surge tank 12. The opening 14 is connected to an air duct (not shown), which directs air that has been filtered by an air cleaner (not shown) to the surge tank 12. The directed air is introduced into the surge tank 12 through the opening 14. Each of the inlet pipes 13, which are arranged in a pair on each of the left and right sides, corresponds to one of the combustion chambers of the horizontally opposed four cylinder engine. Air that has been drawn into the surge tank 12 is supplied to each combustion chamber through one of the inlet pipes 13.

A clearance S is formed between each pair of inlet pipes 13 that are adjacent to each other in the front-rear direction. Each clearance S extends from between the proximal portions to between the distal ends of one of the front-rear adjacent pairs of inlet pipes 13. That is, a pipe wall 13*b*, which constructs each of the inlet pipes 13, is independent from the pipe walls 13*b* of any other inlet pipes 13. Each inlet pipe 13 has an inlet 13*a* connected to the surge tank 12. Each inlet 13*a* is substantially at a position opposed to the inlet 13*a* of another inlet pipe 13. The inlet 13*a* of each inlet pipe 13 is oriented in a direction that intersects the direction of the flow of air that has been supplied to the surge tank 12 through the opening 14. Along the direction of the flow of air, or along the front-rear direction, each inlet 13*a* is side by side with the inlet 13*a* of another inlet pipe 13*a*.

Figure 4:
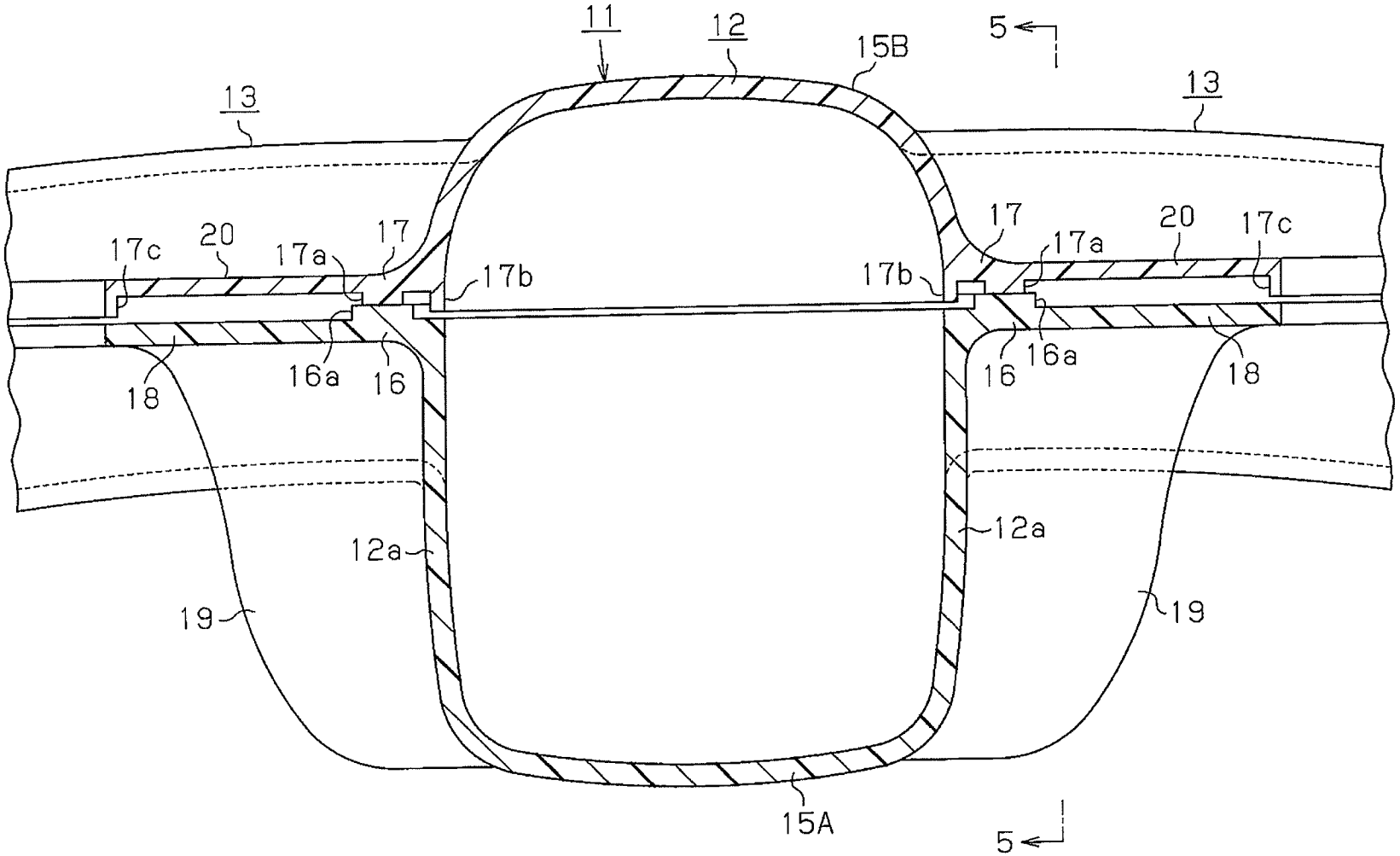
FIG. 4 is a part of a cross-sectional view taken along line 4-4 in FIG. 2, showing the intake manifold of FIG. 1.
Figure 5:
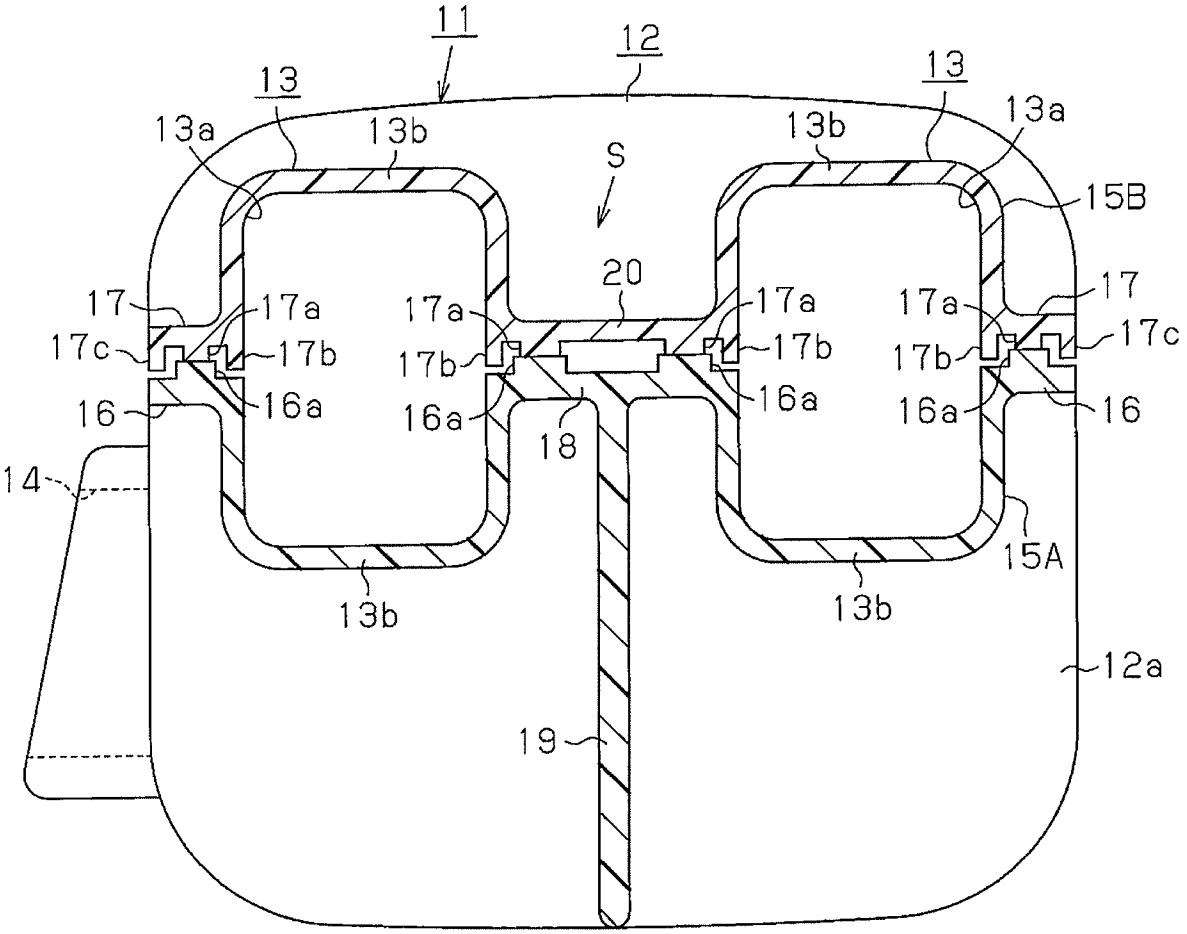
FIG. 5 is a cross-sectional view taken along line 5-5 in FIG. 4, showing the intake manifold of FIG. 1.

As shown in FIG. 1, the intake manifold 11 as a whole is formed by a lower half body 15A and an upper half body 15B. As shown in FIGS. 4 and 5, the lower half body 15A has an open upper end, and the upper half body 15B has an open lower end. The opening 14 of the surge tank 12 is located at a front face of the lower half body 15A. The surge tank 12 and the inlet pipes 13 are formed integrally by placing and joining the upper half body 15B onto the lower half body 15A.

As shown in FIGS. 4 and 5, a flange 16 is formed at the open edge of the lower half body 15A. The flange 16 has a protrusion 16*a* on the upper surface. A flange 17 is formed at the open edge of the upper half body 15B. The flange 17 has a protrusion 17*a* on the lower surface. The flange 16 of the lower half body 15A and the flange 17 of the upper half body 15B have shapes that correspond to each other. A rib 17*b* and a rib 17*c* are formed on the lower surface of the flange 17 of the upper half body 15B. The rib 17*b* and the rib 17*c* are located inside and outside of and away from the protrusion 17*a*, respectively.

The lower half body 15A and the upper half body 15B are joined to each other by placing the upper half body 15B on the lower half body 15A such that the protrusion 16*a* of the lower half body 15A and the protrusion 17*a* of the upper half body 15B face each other, and then vibrating the half bodies 15A, 15B. The vibration applied to the half bodies 15A, 15B generates frictional heat between the protrusion 16*a* and the protrusion 17*a*, so that the protrusions 16*a*, 17*a* function as welding margins. That is, the half bodies 15A, 15B of the intake manifold 11 are vibration welded to each other using the protrusions 16*a*, 17*a* as welding margins.

As shown in FIG. 3, portions of each protrusion 16*a*, 17*a* that are located to correspond to the proximal portions of the inlet pipes 13 are wider than the remainders of the same protrusion 16*a*, 17*a*. Further, portions of each protrusion 16*a*, 17*a* that are close to the left and right side walls of the surge tank 12 are gradually widened toward the proximal portions of the respective inlet pipes 13. Therefore, the joint between the lower half body 15A and the upper half body 15B is firmer at the left and right side walls of the surge tank 12 and at the proximal portions of the inlet pipes 13 than at other parts.

The lower half body 15A has plate-like connecting portions 18, each located between the proximal portions of one of the front-rear adjacent pairs of inlet pipes 13. Each connecting portion 18 is continuous to the flange 16. Each connecting portion 18 fills the clearance S between one of the front-rear adjacent pairs of inlet pipes 13, and is formed integrally with the lower half body 15A. A reinforcing rib 19 extends downward from a center in the front-rear direction of each connecting portion 18. Each reinforcing ribs 19 are continuous to one of the left and right side walls of the surge tank 12 and formed integrally with the lower half body 15A. The upper half body 15B has connecting portions 20 that correspond to the connecting portions 18 of the lower half body 15A. Each connecting portion 20 of the upper half body 15B is located between the proximal portions of one of the front-rear adjacent pairs of inlet pipes 13, and is continuous to the flange 17. Each connecting portion 20 fills the clearance S between one of the front-rear adjacent pairs of inlet pipes 13, and is formed integrally with the upper half body 15B.

As illustrated in FIGS. 2 and 3, the lower half body 15A has attachment seats 21, which are formed integrally with the lower half body 15A. Each attachment seat 21 is provided at the distal ends of one of the front-rear adjacent pairs of inlet pipes 13. Each attachment seat 21 has a plurality of attachment holes 22, which are used for securing the entire intake manifold 11 to a cylinder block (not shown) of the engine with bolts (not shown).

As described above, the lower half body 15A has the connecting portions 18, and the upper half body 15B has the connecting portions 20. Thus, when molding the lower half body 15A and the upper half body 15B, it is possible to prevent deformation and displacement from being caused at the proximal portions of the inlet pipes 13 due to molding strains. Particularly, unlike the lower half body 15A having the attachment seats 21, the upper half body 15B of the intake manifold 11, which is indicated by lines formed by a long dash alternating with two short dashes in FIG. 1, has the inlet pipes 13 the distal ends of which are free ends. Therefore, molding strains are likely to be generated in the inlet pipes 13 of the upper half body 15B. In this regard, according to the present embodiment, since the connecting portions 20 are each provided between the proximal portions of one of the front-rear adjacent pairs of inlet pipes 13, the generation of molding strains in the inlet pipes 13 of the upper half body 15B is suppressed.

In an engine having the intake manifold 11 of the present embodiment, air that is taken into the surge tank 12 through the opening 14 is drawn into each inlet pipe 13 through one of the inlets 13*a*, and then supplied to the intake system of the engine. In this case, when negative pressure is produced in the surge tank 12 and the inlet pipes 13, stress is concentrated on the left and right side walls of the surge tank 12 and the proximal portions of the inlet pipes 13. Also, when a back-fire occurs in the intake manifold 11 and the interior pressure of the intake manifold 11 increases, stress is concentrated on the same locations. In this regard, each of the protrusion 16*a* of the lower half body 15A and the protrusion 17*a* of the upper half body 15B, which are used as welding margins, includes parts that are close to the left and right side walls of the surge tank 12. These parts of each protrusion 16*a*, 17*a* are wider than the remainder of the same protrusion 16*a*, 17*a*. Therefore, the proximal portions of the inlet pipes 13 have relatively high pressure capacity. This prevents abnormal deformation of the surge tank 12 and the inlet pipes 13, and detachment of the welded portions.

Further, the connecting portions 18, 20 are each provided between the proximal portions of one of the front-rear adjacent pairs of inlet pipes 13, and each reinforcing rib 19, which is continuous to one of the left and right side walls of the surge tank 12, extends downward from one of the connecting portions 18 of the lower half body 15A. This further reliably prevents abnormal deformation of the surge tank 12 and the inlet pipes 13, and detachment of the welded portions.

Accordingly, the present embodiment has the following advantages.

In the intake manifold 11 of the present embodiment, the proximal portions of each pair of inlet pipes 13 that are adjacent to each other in the front-rear direction are connected to each other by one of the connecting portions 18 and one of the connecting portions 20, so that the proximal portions are integrated with each other. Each connecting portion 18 of the lower half body 15A is connected to one of the left and right side walls of the surge tank 12 by corresponding one of the reinforcing ribs 19, so that the proximal portions of each pair of inlet pipes 13 that are adjacent to each other in the front-rear direction are integrated with one of the left and right side walls of the surge tank 12. Therefore, the left and right side walls of the surge tank 12 and the proximal portions of the inlet pipes 13 have relatively high pressure capacity, so that abnormal deformation of the surge tank 12 and the inlet pipes 13 or detachment of the welded portions is unlikely to occur. Also, molding strains are unlikely to be generated in the vicinity of the proximal portions of the inlet pipes 13.

Further, since the left and right side walls of the surge tank 12 and the proximal portions of the inlet pipes 13 have a relatively high pressure capacity, the configuration requires no additional members such as internal pipes to increase the pressure capacity, unlike the intake manifold of Japanese Laid-Open Patent Publication No. 2008-184939. This reduces the number of components of the intake manifold 11 and thus simplifies the structure of the intake manifold 11.

Each of the protrusion 16*a* of the lower half body 15A and the protrusion 17*a* of the upper half body 15B, which are used as welding margins, includes parts that are located to correspond to the proximal portions of the inlet pipes 13. These parts of each protrusion 16*a*, 17*a* are wider than the remainder of the same protrusion 16*a*, 17*a*. This reinforces the joint between the half bodies 15A and 15B at the left and right side walls of the surge tank 12 and the inlet pipes 13, thereby increasing the pressure capacity of the same locations.

The above embodiment may be modified as follows.

The number of the inlet pipes 13 may be changed as necessary in accordance with the number of cylinders in an engine. For example, three inlet pipes 13 may be provided on either of the left and right side of the surge tank 12, so that the intake manifold 11 is used in a horizontally-opposed six-cylinder engine.

In the above embodiment, a clearance S is located between each pair of inlet pipes 13 that are adjacent to each other in the front-rear direction, and each front-rear adjacent pair of inlet pipes 13 are connected to each other by one of the connecting portions 18 and one of the connecting portions 20. However, the pipe walls 13*b* of each front-rear adjacent pair of inlet pipes 13 may be joined to each other without providing a clearance S between the pair of inlet pipes 13. In this case, each reinforcing rib 19 is provided to extend from the joint between the pipe walls 13*b* of one of the front-rear adjacent pairs of inlet pipes 13 to corresponding one of the left and right side walls of the surge tank 12.

The invention claimed is:

1. An intake manifold comprising:

an upper half body; and a lower half body welded to the upper half body, the welded intake manifold including:

a surge tank having an opening; and a plurality of inlet pipes extending from the surge tank, each inlet pipe having a proximal end and a distal end, each inlet pipe having an inlet provided at a side wall of the surge tank, and the inlet of each inlet pipe being located side by side with the inlet of another inlet pipe in a direction along which air supplied into the surge tank through the opening flows within the surge tank, wherein, proximal portions of an adjacent pair of the inlet pipes are integrated via a plate-like connecting portion provided therebetween, and the plate-like connecting portion is integrated with the side wall of the surge tank by a reinforcing rib that extends perpendicular from the plate-like connecting portion between the proximal portions of the adjacent pair of inlet pipes to a lower portion of the side wall of the surge tank, and wherein the half bodies are welded to each other via welding margins provided in the half bodies, and the welding margins extending from the proximal end to the distal end of each inlet pipe and widened toward the proximal portions of the adjacent pair of inlet pipes.

2. The intake manifold according to claim 1, wherein a clearance is formed between the pair of inlet pipes.

3. The intake manifold according to claim 1, wherein the plate-like connecting portion includes a lower connecting portion provided in the lower half body and an upper connecting portion provided in the upper half body.

4. The intake manifold according to claim 1, wherein two or more of the inlet pipes are provided on either side of the surge tank.

* * * * *